United States Patent [19]

Nishimura et al.

[11] Patent Number: 4,987,765

[45] Date of Patent: Jan. 29, 1991

[54] METHOD AND APPARATUS FOR MULTI-STEP WORKPIECE MANUFACTURING

[75] Inventors: Tatsuo Nishimura; Makoto Chikama; Koichi Ogiwara, all of Yokohama, Japan

[73] Assignee: Hashimoto Forming Industry Co., Ltd., Kanagawa, Japan

[21] Appl. No.: 440,030

[22] Filed: Nov. 21, 1989

[30] Foreign Application Priority Data

Nov. 25, 1988 [JP] Japan ..... 63-296234

[51] Int. Cl.[5] ..... B21D 43/00

[52] U.S. Cl. ..... 72/405; 72/442; 72/446; 72/420; 72/421; 29/33 J; 29/36; 29/563; 83/563

[58] Field of Search ..... 72/442, 446, 405, 404, 72/448, 472, 420, 421, 422; 29/36, 563, 33 J, 39; 83/563

[56] References Cited

U.S. PATENT DOCUMENTS

| | | | |
|---|---|---|---|
| 3,937,057 | 2/1976 | Trolle | 72/446 |
| 4,449,390 | 5/1984 | Pontini | 72/405 |

FOREIGN PATENT DOCUMENTS

| | | | |
|---|---|---|---|
| 587290 | 1/1959 | Italy | 72/405 |
| 41630 | 3/1983 | Japan | 72/422 |
| 42145 | 3/1984 | Japan | 72/421 |
| 81230 | 4/1987 | Japan | 72/421 |
| 2038681 | 7/1980 | United Kingdom | 72/422 |

*Primary Examiner*—David Jones

*Attorney, Agent, or Firm*—Weiser & Stapler

[57] ABSTRACT

A method and an apparatus for manufacturing a workpiece in plurality of manufacturing steps with small time losses between successive manufacturing steps, which utilizes a small number of manufacturing machines, according to which the manufacturing machines and the transferring machines are controlled such that while one manufacturing step is being applied by one manufacturing machine and then the workpiece is being transferred by the transferring machine from that one manufacturing machine to another manufacturing machine for applying a next manufacturing step to the workpiece, the another manufacturing machine is prepare for the next manufacturing step by placing an appropriate one of the manufacturing press dies under the ram of the press machine of the another manufacturing machine by intermittently moving the plurality of manufacturing press dies.

10 Claims, 13 Drawing Sheets

METHOD AND APPARATUS FOR MULTI-STEP WORKPIECE MANUFACTURING

BACKGROUND OF THE INVENTION

1. Field of the Invention

The present invention relates to a method and an apparatus for manufacturing a workpiece by applying desired manufacturing processes with respect to a workpiece which requires a plurality of manufacturing steps.

2. Description of the Background Art

A long workpiece with a complex cross sectional shape is usually used for a pressing of automobile and an architectural window sashes. Such a long workpiece requires its end portions to be manufactured by a manufacturing process comprising multiple steps including such steps as cutting, chipping and piercing. In such a manufacturing process, desired shapes at end portions are obtained by applying the manufacturing steps for each portion separately, using a plurality of metal press dies corresponding to each of the manufacturing steps.

Conventionally, in a manufacturing apparatus for applying such a manufacturing process a plurality of metal press dies are linearly arranged on a single press apparatus, and workpieces are carried in and out with respect to each metal press die and transferred by a worker, as disclosed in U.S. patent application Ser. No. 4,676,090 by Nishmura et al.

Now, in such a conventional manufacturing apparatus, the workpiece has to be transferred to positions corresponding to a plurality of metal press dies in order, so that the work is cumbersome, time consuming, and less productive. Because of this, a use of a robot operating under a numerical control to transfer the workpiece with respect to the press apparatus may be considered.

However, the press apparatus has a large size because the plurality of metal press dies are linearly arranged, which is particularly so in cases such as that for an automobile window sashes in which manufacturing steps for a long workpiece exceeds ten steps, so that a required operational region of the robot becomes quite enlarged, and as result an automatization of the manufacturing becomes difficult.

SUMMARY OF THE INVENTION

It is therefore an object of the present invention to provide a method and an apparatus for multi-step workpiece manufacturing which can make the automatization of the manufacturing process easier and improve the productivity of the manufacturing process, even in cases in which the manufacturing steps involved in the manufacturing process are numerous.

According to one aspect of the present invention there is provided an apparatus for manufacturing a workpiece, comprising: at least two manufacturing means for applying manufacturing steps to the workpiece, each one of which including: a press machine having a ram; a table means for carrying a plurality of manufacturing press dies corresponding to different manufacturing steps to be applied to the workpiece, the table means being capable of moving the manufacturing press dies intermittently under the ram of the press machine such that any one of the manufacturing press dies can be placed under the ram of the press machine selectively; means for transferring the workpiece among the manufacturing means, capable of transferring the workpiece in and out of one manufacturing press die of one manufacturing means placed under the ram of the press machine; means for controlling the manufacturing means and the transferring means such that while one manufacturing step is being applied by one manufacturing means and then the workpiece is being transferred by the transferring means from that one manufacturing means to another manufacturing means for applying a next manufacturing step to the workpiece, the table means of the another manufacturing means is intermittently moved to prepare for the next manufacturing step by placing an appropriate one of the manufacturing press dies under the ram of the press machine of the another manufacturing means.

According to another aspect of the present invention there is provided a method of manufacturing a workpiece, comprising the steps of: (a) providing at least two manufacturing means for applying manufacturing step to the workpiece, each one of which including: a press machine having a ram; a table means for carrying a plurality of manufacturing press dies corresponding to different manufacturing steps to be applied to the workpiece, the table means being capable of moving the manufacturing press dies intermittently under the ram of the press machine such that any one of the manufacturing press dies can be placed under the ram of the press machine selectively; (b) providing means for transferring the workpiece among the manufacturing means, capable of transferring the workpiece in and out of one manufacturing press die of one manufacturing means placed under the ram of the press machine; (c) controlling the manufacturing means and the transferring means such that while one manufacturing step is being applied by one manufacturing means and then the workpiece is being transferred by the transferring means from that one manufacturing means to another manufacturing means for applying a next manufacturing step to the workpiece, the table means of the another manufacturing means is intermittently moved to prepare for the next manufacturing step by placing an appropriate one of the manufacturing press dies under the ram of the press machine of the another manufacturing means.

Other features and advantages of the present invention will become apparent from the following description taken in conjunction with the accompanying drawings.

DETAILED DESCRIPTION OF THE PREFERRED EMBODIMENTS

Figure 1:
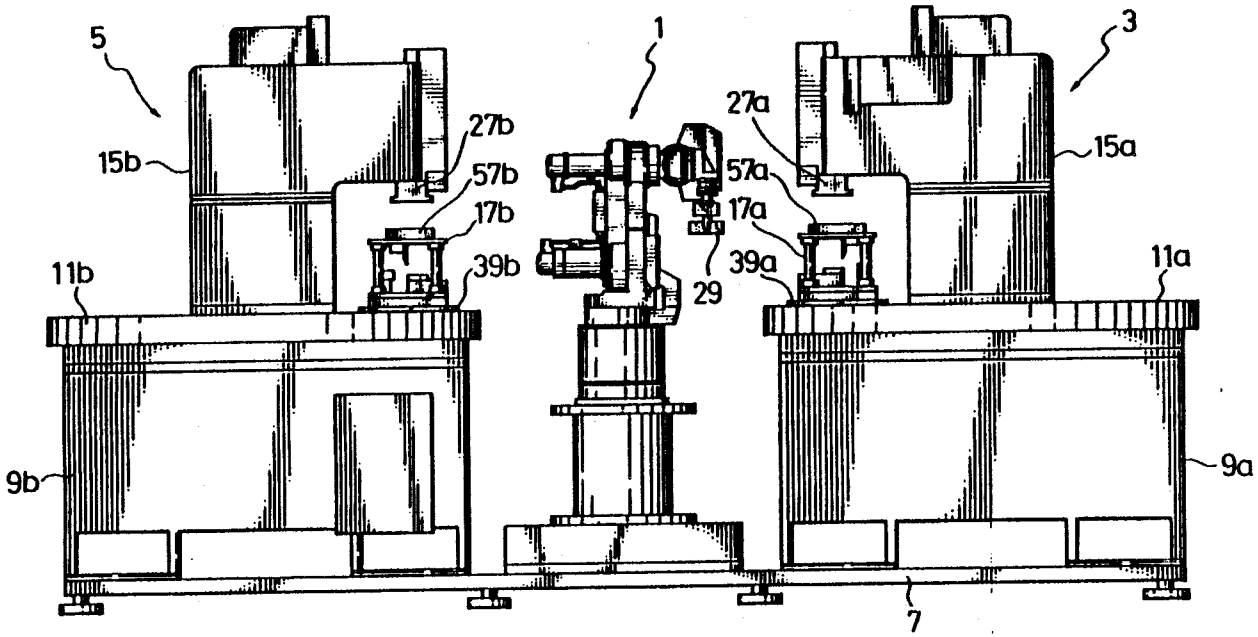
FIG. 1 is a front view of one embodiment of a workpiece manufacturing apparatus according to the present invention.
Figure 2:
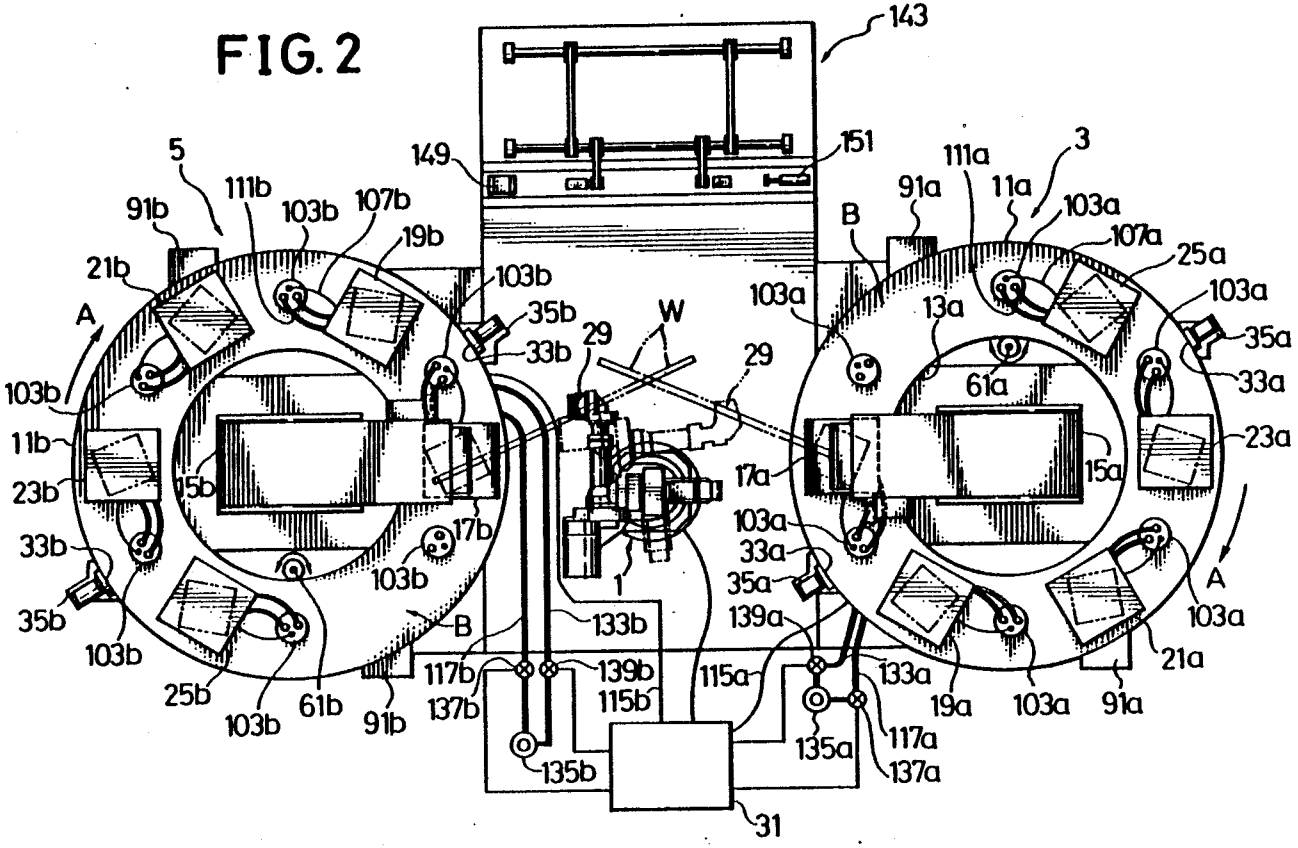
FIG. 2 is a plan view of the workpiece manufacturing apparatus of FIG. 1.

Referring now to FIGS. 1 and 2, there is shown one embodiment of a workpiece manufacturing apparatus according to the present invention.

This manufacturing apparatus is for performing manufacturing process including a plurality of manufacturing steps such as cutting and chipping to both ends of a long body of a workpiece W which is to be used as an automobile window sashes.

The manufacturing apparatus generally comprises a multi-joint robot 1 placed in a middle of a first press apparatus 3 and a second press apparatus 5, all of which are mounted at prescribed positions on a base plate 7. This manufacturing apparatus is further equipped with a control unit 31 and a workpiece carrier apparatus 143, as can be seen in FIG. 2. Each of these elements of the manufacturing apparatus will be described in detail below. In the following, since the first press apparatus 3 and the second press apparatus 5 can be considered to have an identical structure, the description of the press apparatus will be given only for the first press apparatus 3. In figures, the elements of the second press apparatus 5 will be labeled by the reference numerals accompanied by letter b in correspondence with the elements of the first press apparatus 3 labeled by the reference numerals accompanied by letter a. It is to be noted that everything that will be described for the element of the first press apparatus 3 in the following description equally applied to the corresponding elements of the second press apparatus 5.

The first press apparatus 3 comprises a ring-shaped rotary table 11*a* with a middle opening 13*a* which is intermittently rotatable over a base frame 9*a*, and a press machine 15*a* located in the middle opening 13*a* of the rotary table 11*a*.

On the rotary table 11*a*, along a circumferential direction, at 60° interval, six metal press dies of different cutter shapes can be attached. In FIG. 2, five metal press dies 17*a*, 19*a*, 21*a*, 23*a*, and 25*a* corresponding to the different manufacturing steps for a workpiece W are attached while one remaining spot is left as a blank spot B. A prescribed manufacturing process is to be performed on ends of the workpiece W as a vertically movable ram 27*a* of the press machine 15*a* is lowered to press down one of the metal press dies 17*a*–25*a* while the rotary table 11*a* is at rest.

The multi-joint robot 1 grips the workpiece W at its unmanufactured portion at an approximate middle by a hand 29 and transfer this workpiece W in and out alternatively between the first press apparatus 3 and the second press apparatus 5 in accordance with the order of manufacturing. This multi-joint robot 1 holds the workpiece W such that the workpiece W is rotatable with respect to an axis along its length direction, as well as transferable in and out of the press apparatuses 3 and 5, and is structured to bend its joints in response to a predetermined controlling using numerical control, playback, variable sequence, or fixed sequences by the control unit 31 which utilizes a microcomputer as a controlling circuit. Also, this multi-joint robot 1 has a sensor (not shown) for detecting the gripping of the workpiece W by the hand 29.

The control unit 31, in addition to administer the aforementioned controlling of the multi-joint robot 1, makes the rotary table 11*a* to intermittently rotates each of the metal press dies 17*a*–25*a* and 17*b*–25*b* in accordance with the order of manufacturing in correspondence with this control. As for the blank spot B on the rotary table 11*a*, a jumping operation to skip the blank spot B can be effectuated by manually controlling snappper switches provided on an operation panel (not shown) for each of the spots for metal press dies on the rotary table 11*a* and 11*b*.

On an outer circumference of the rotary table 11*a*, there is a break 35*a* which has a break shoe 33*a* for stopping the rotation and is actuated by an actuator such an an air cylinder associated with it. On the other hand, on the rotary table 11*a*, there are discharge holes (not shown) for dropping chips generated by the manufacturing located at bottom faces of each of the metal press dies 17*a*–25*a*. Furthermore, on the base frame 9*a* below the rotary table 11*a* there are vertically movable stoppers (not shown) which move into the draining holes shortly after the actuation of the break 35*a* to restrict the stopping position of the rotary table 11*a*. Moreover, on the base frame 9*a* below the rotary table 11*a* there are vertically movable positioning pins (not shown) which move into holes (not shown) provided on the rotary table 11*a* to fix the stopping position of the rotary table 11*a*.

Figure 3:
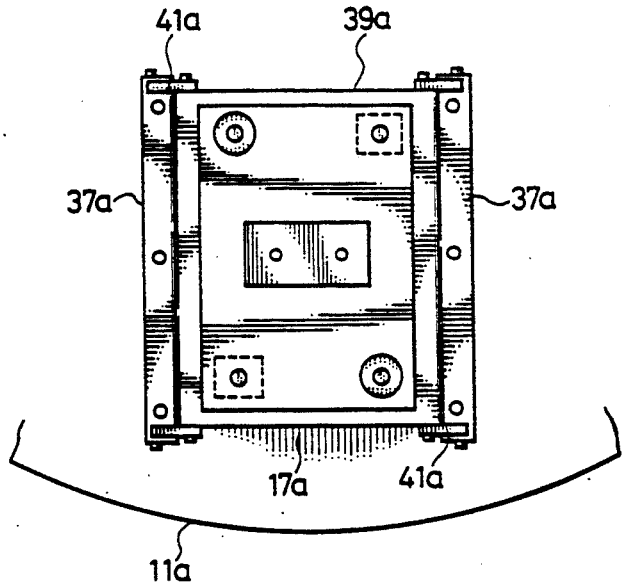
FIG. 3 is a plan view of a metal press die to be equipped on a rotary table of the workpiece manufacturing apparatus of FIG. 1.
Figure 4:
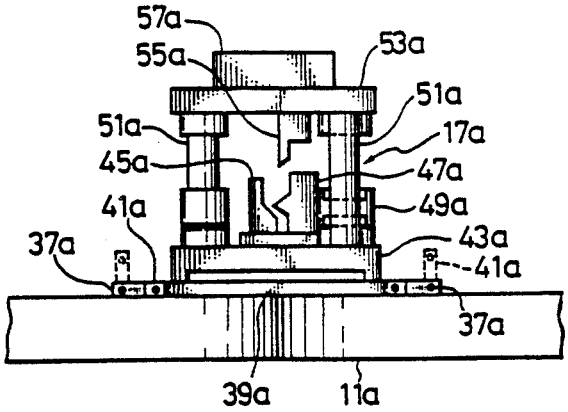
FIG. 4 is a front view of the metal press die of FIG. 3.
Figure 5:
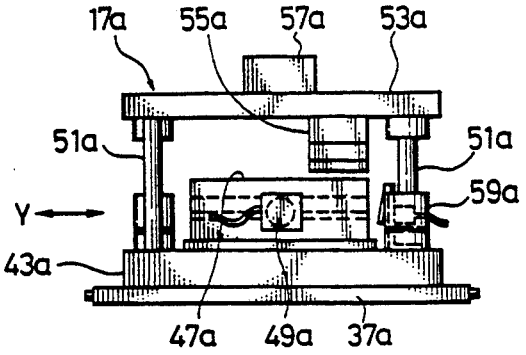
FIG. 5 is a side view of the metal press die of FIG. 3.

The metal press dies 17*a*–25*a* can be floating dies each of which, as shown in FIG. 3, is attached onto the rotary table 11*a* by positioning a die base plate 39*a* equipped with a pair of left and right die guides 37*a* provided on a plate portion of the rotary table 11*a*, and fixing with plurality of rotation stoppers 41*a*. A floating die to be used as each of the metal press dies 17*a*–25*a* has, as shown in FIG. 4, a fixed die 45*a* and a movable die 47*a* on a die plate 43*a*, of which the movable die 47*a* is equipped with an air cylinder 49*a* for moving it towards and away from the fixed die 45*a*, so as to be able to hold the workpiece W in between the fixed die 45*a* and the movable die 47*a*. This air cylinder 49*a* is attached to the movable die 47*a* in detachable manner by means of an snap-on connector. Also, the die plate 43*a* has plurality of guide posts 51*a*, and a punch plate 53*a* supported in vertically movable manner by these guide posts 51a has a punch 55a on its lower face. Over the punch plate 53a, there is a block 57a for controlling a vertical stroke of the punch 55a. In addition, as shown in FIG. 5, there is provided a workpiece end position detector 59a such as a limit switch or a photoelectric switch which is detachably attached by means of a socket, at a position along the direction of transferring of the workpiece W (direction indicated by an arrow Y) further back of the fixed die 45a, the movable die 47a and the punch 55a.

Figure 6:
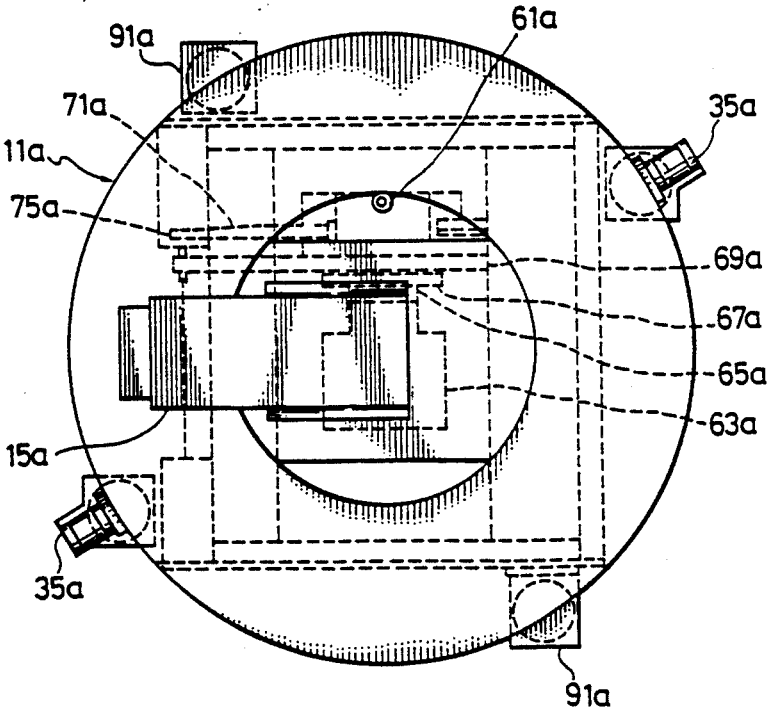
FIG. 6 is a plan view of a rotary table of the workpiece manufacturing apparatus of FIG. 1.
Figure 7:
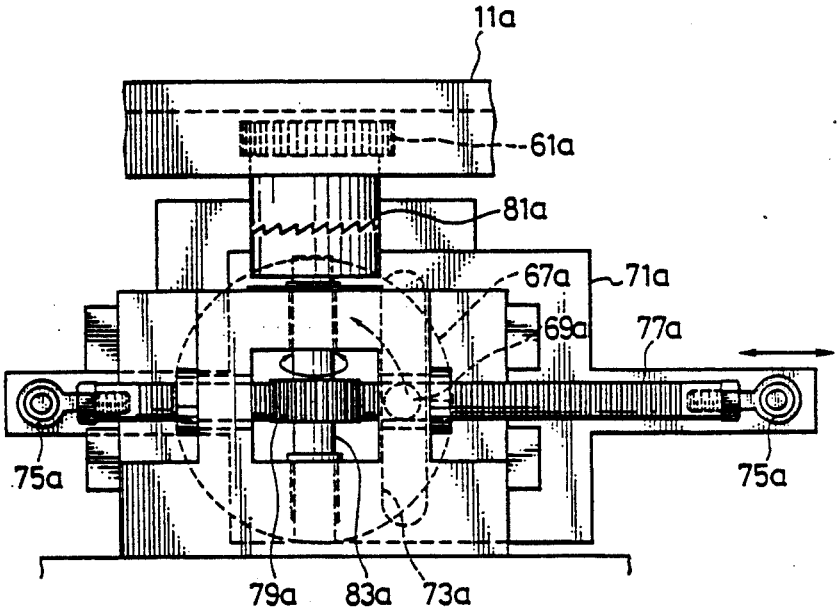
FIG. 7 is a side view of a driving portion of the rotary table of FIG. 6 for explaining its motion.
Figure 8:
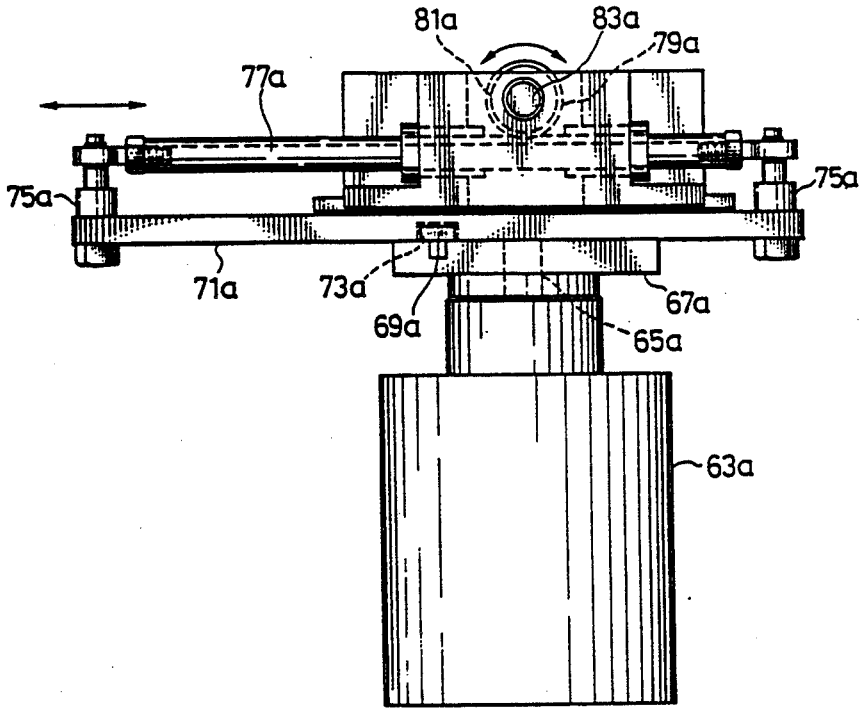
FIG. 8 is a top view of a driving portion of the rotary table of FIG. 6 for explaining its motion.
Figure 9:
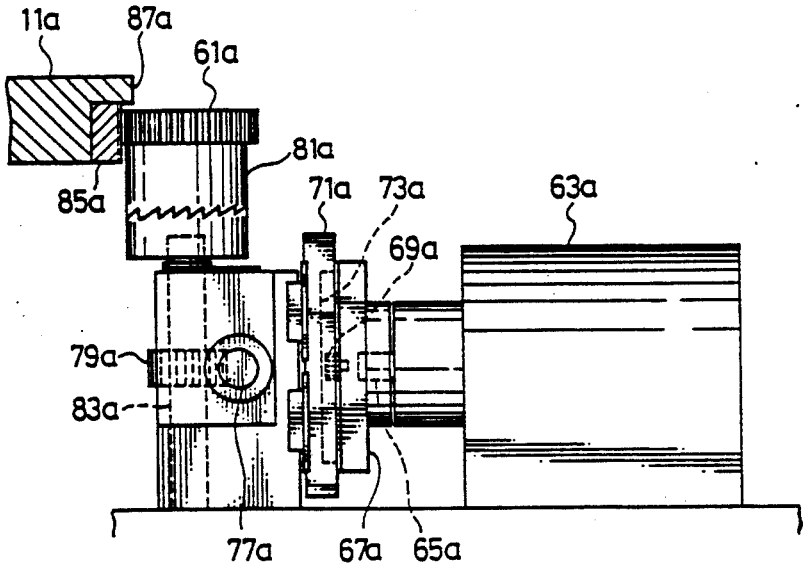
FIG. 9 is another side view of a driving portion of the rotary table of FIG. 6 for explaining its motion.
Figure 10:
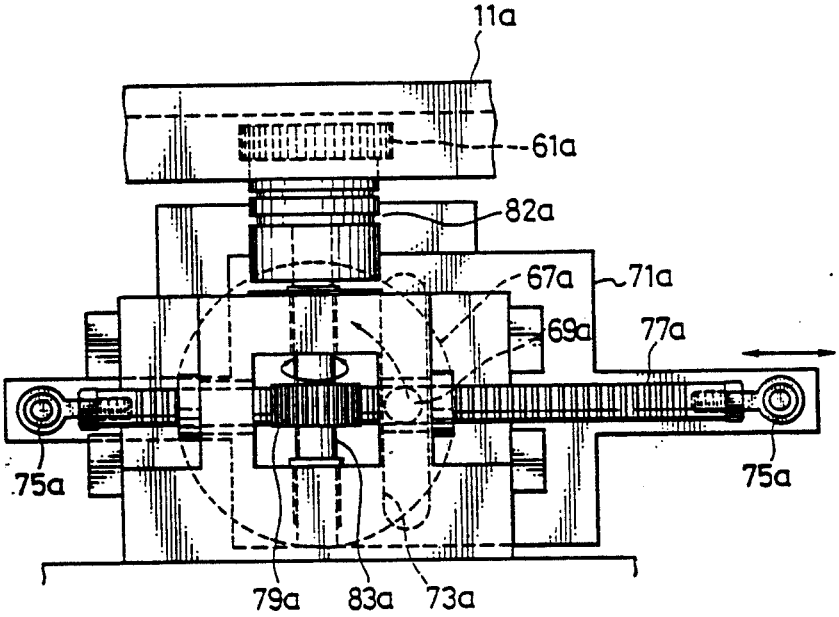
FIG. 10 is a side view of an alternative configuration for a driving portion of the rotary table of FIG. 6.

An inner circumference of the rotary table 11a is engaged with a gear 61a, which is intermittently driven by a driving motor 63a as shown in FIG. 6. The driving motor 63a has a decelerator and is preferably be having a larger rotational torque. As shown in FIGS. 7 to 9 in various perspective, in this driving motor 63a, a rotary plate 67a is axially connected with a rotational axis 65a of the driving motor 63a, a pin 69a extending from an eccentric position on the rotary plate 67a is thrusted into a cam groove 73a provided on a horizontally movable plate 71a, a rack bar 77a, which is supported by supporters 75a on left and right sides of the horizontally movable plate 71a so as to be parallel to the horizontally movable plate 71a, is engaged with a pinion 79a, and the pinion 79a is attached to a driving axis 83a of an one way clucth 81a which is united with the gear 61a. As shown in FIG. 10, the one way clutch 81a in this driving motor 63a may be replaced by a electromagnetically controllable air friction clutch to be controlled in a desired manner by the control unit 31.

Figure 11:
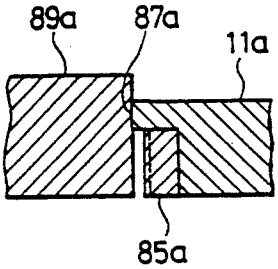
FIG. 11 is a partial cross sectional view of an inner circumference side of the rotary table of FIG. 6.

Furthermore, as shown in FIG. 11, the inner circumference of the rotary table 11a has a inner toothed wheel 85a to be engaged with the gear 61a, on a part of which there is formed a full circular portion 87a to be placed in contact with a guiding plate 89a which is to be placed inside the rotary table 11a.

Figure 12:
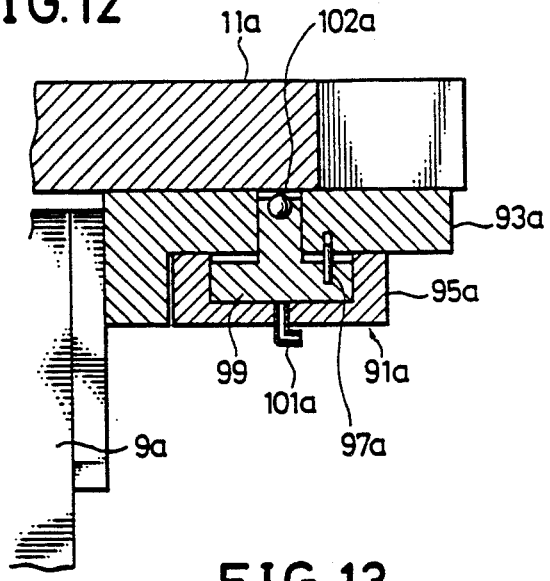
FIGS. 12 and 13 are cross sectional views of a lifting mechanism to be incorporated on the rotary table of FIG. 6 for explaining its structure and motion.
Figure 13:
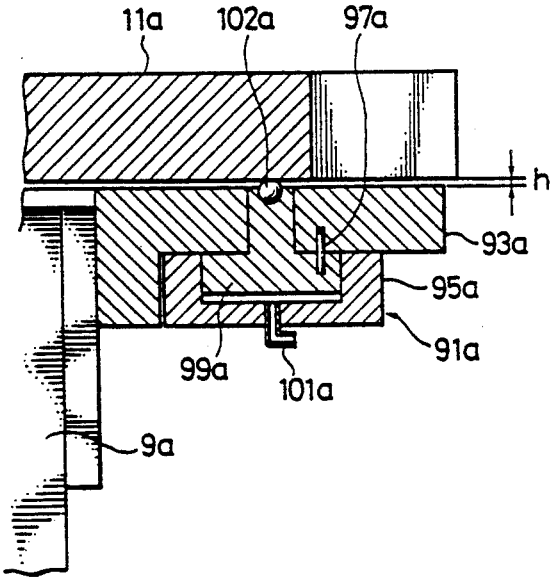

Around the outer circumfernce of the rotary table 11a, there are also provided lifting mechanisms 91a for lifting the rotary table 11a up when it is to be rotated. As shown in FIGS. 12 and 13, each of these lifting mechanisms 91a comprises a supporting plate 93a attached at an appropriate location on the base frame 9a, a cylinder 95 attached below the supporting plate 93a, a piston 99a placed between the supporting plates 93a and the cylinder 95a which is held to be rotationless by means of a guiding pin 97a, a supply nozzle 101a for applying air pressure on the piston 99a which is connected to a bottom of the cylinder 95a, and a roller 102a such as radial bearing of spherical or cylindrical shape attached at a top of the piston 99a which lifts the rotary table 11a by an height h when the piston 99a is moved to its raised position by means of the air pressure from the supply nozzle 101a.

The air supply to the air cylinder 49a for moving the movable die 47a towards the fixed die 45a, and the electricity conduction to the workpiece end position detector 59a for detecting the transferring of the workpiece W into the metal press dies 17a–25a are both provided through an energy transmitting unit 103a located nearby each of the metal press dies 17a–25a on the rotary table 11a, as shown in FIG. 2.

Figure 14:
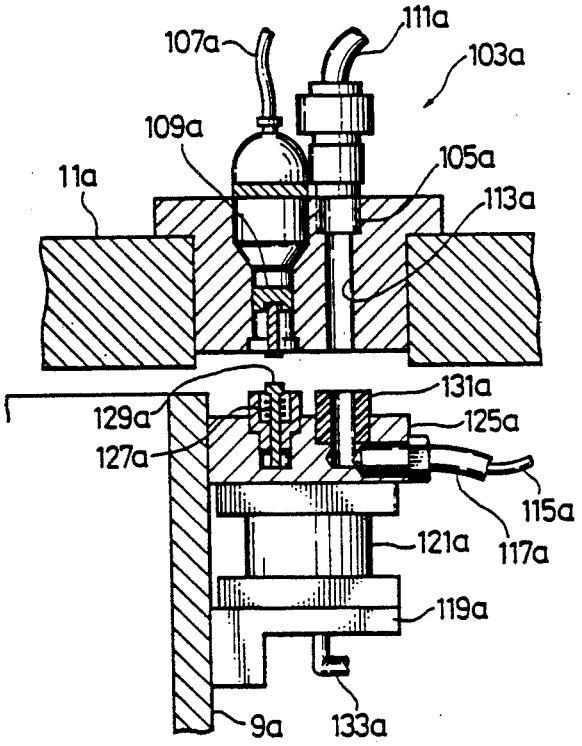
FIGS. 14 and 15 are cross sectional views of an energy transmitting unit to be incorporated on the rotary table of FIG. 6 for explaining its structure and motion.
Figure 15:
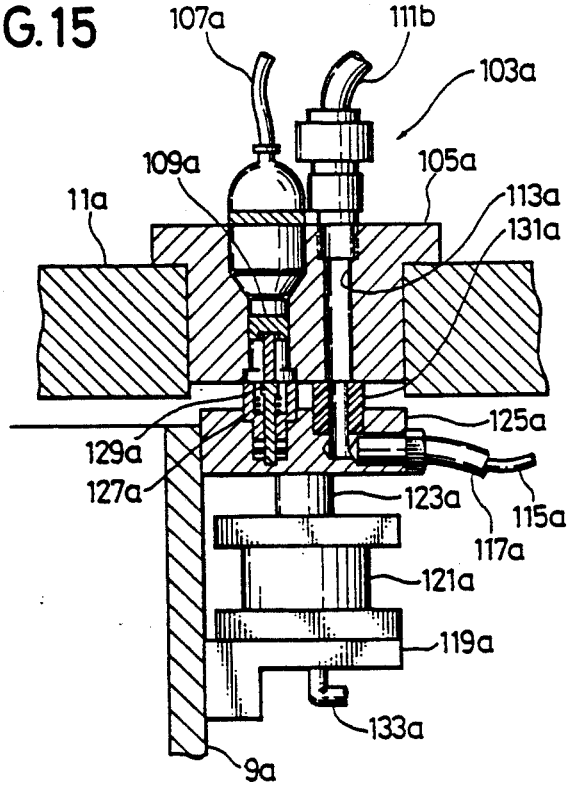

As shown in FIGS. 14 and 15, the energy transmitting unit 103a comprises a socket holder 105a attached to the rotary table 11a which has a connection path 113a to be connected to an air tube 111a for supplying the air to the air cylinder 49a, and a socket side junction point 109a to be electrically connected with a lead 107a for supplying the electric current to the workpiece end position detector 59a. In addition, beneath the socket holder 103a the energy transmitting unit 103a further comprises an air cylinder 121a held by a supporting bracket 119a attached at an appropriate position on the base frame 9a, preferably in a vicinity of the vertically movable ram 27a of the press machine 15a as shown in FIG. 2, and a plug holder 125a attached at a top of a rod 123a of the air cylinder 121a, which houses a plug side junction point 129a thrusted upwards by a spring 127a which is to be connected with a lead 115a from the control unit 31 and a cylindrical air supply connector 131a having a good shielding property which is to be connected with an air supply tube 117a. Also, at a bottom of the supporting bracket 119a, there is connected another air supply tube 133a for supplying air to the air cylinder 121a. The air supply tubes 117a and 133a are connected with a pressure source 135a such as an air tank, and the air supply tubes 117a and 133a have electromagnetic solenoid valves 137a and 139a, respectively, connected in their middles which are opened and closed by the control unit 31.

The detection of ends of the workpiece W and fixing of the workpiece W to the metal press dies are accomplished by means of the energy transmitting unit 103a, by extending the air cylinder 121a for a stroke length when the rotary table 11a is at rest, and connecting the socket side junction point 109a with the plug side junction point 129a, as well as the path 113a with the air supply connector 131a.

The air supply nozzle 101a of each of the lifting mechanisms 91a is also connected with the pressure source 135a through the air tube, although this feature is not shown in FIG. 2, and this air tube also has in a middle an electromagnetic solenoid valve which is opened and closed by the control unit 31.

The cylinder 95a of each of the lifting mechanisms 91a as well as the air cylinder 49a of each of the metal press dies 17a–25a are connected to exhaust tubes (not shown) for exhausting the air inside the cylinders 95a and 49a in lowering the rotary table 11a and in releasing the grip of the workpiece W between the fixed die 45a and movable die 47a, respectively, and each of such exhaust tubes also has in a middle an electromagnetic solenoid valve which is opened and closed by the control unit 31.

Figure 16:
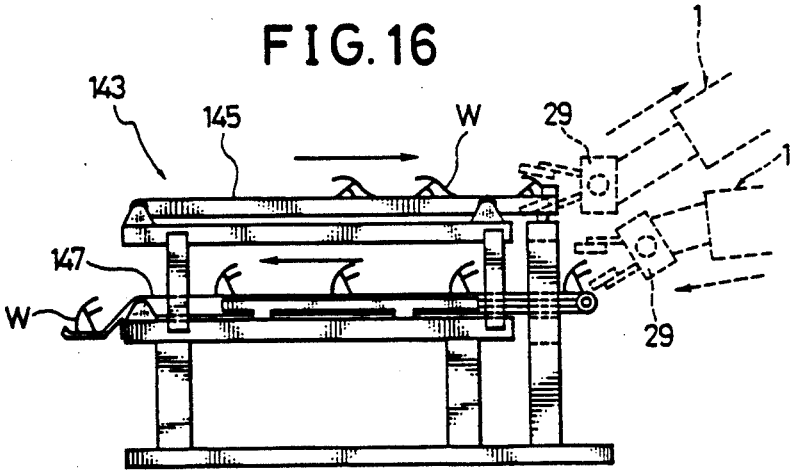
FIG. 16 is a side view of a workpiece carrier apparatus and a hand of a multi-joint robot in the workpiece manufacturing apparatus of FIG. 1.

The workpiece carrier apparatus 143 is intermittently actuated whenever all the manufacturing process for one workpiece W is completed in order to receive the finished workpiece W and to supply a new workpiece W to be maunfactured. This workpiece carrier apparatus 143 has a carry-in conveyor 145 on upper level and a carry-out conveyor 147 on lower level as shown in FIG. 16. To the ends of the carry-in conveyer 145 and the carry-out conveyor 147 the workpiece W is transferred in and out by the hand 29 of the multi-joint robot 1. The workpiece carrier apparatus 143 is further equipped with a workpiece positioning member 149 and a positioning cylinder 151, both for securing the position of the workpiece W at the end of the carry-in conveyer 145 so as to keep the new workpiece W to be manufactured in a position to be grabbed by the hand 29 of the multi-joint robot 1.

The operation of this embodiment of a workpiece manufacturing apparatus will now be explained.

Figure 17A:
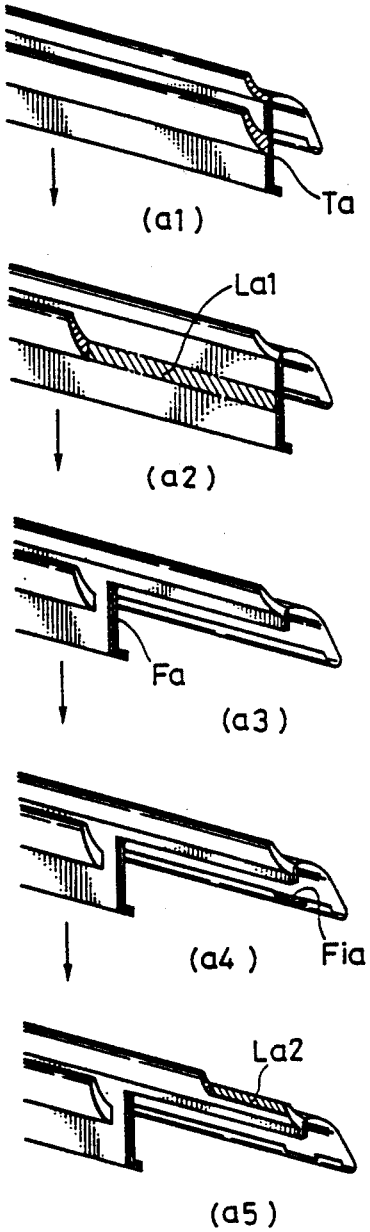
FIGS. 17(A) and (B) are perspective views of one end and the other end, respectively, of a workpiece to be manufactured by the workpiece manufacturing apparatus of FIG. 1 for explaining the order to manufacturing steps to be apllied.

In this workpiece manufacturing apparatus, two ends of a long workpiece W formed from a synthetic resin on a surface of metal core by a composite extrusion is to receive an end treatment manufacturing in the order shown in FIGS. 17(A) and (B). This end treatment manufacturing is given such that one end is given a prescribed manufacturing by the metal press dies 17a–25a of the first press apparatus 3, while the other end is given a prescribed manufacturing by the metal press dies 17b–25b of the second press apparatus 5. The end treatment shown in FIG. 17(A) which comprises a sequence of manufacturing steps (a1)–(a5) are done by the firsr press apparatus 3, whereas the end treatments shown in FIG. 17(B) which comprises a sequence of manufacturing steps (b1)–(b5) are done by the second press apparatus 5.

In detail, this end treatment manufacturing is done by the workpiece manufacturing apparatus as follows.

First, the control unit 31 opens the electromagnetic solenoid valve 139a associated with the air tube 133a to start supplying the air to the air cylinder 121a such that the rod 123a of the air cylinder 121a is extended while the rotary table 11a remains at rest. As a result, the socket side junction point 109a and the plug side junction point 129a are joined to become conductive, and the path 113a the air supply connector 131a is joined to become connected.

In this state, the multi-joint robot 1 grips on an approximate middle of the workpiece W carried by the carry-in conveyer 145 of the workpiece carrier apparatus 143, and swings around to insert one end of the workpiece W into the metal press die 17a of the first press apparatus 3.

When the workpiece end position detector 59a associated with the metal press die 17a detects this insertion of the workpiece W, a detection signal is transmitted to the control unit 31 through the connected socket side and plug side junction points 109a and 129a.

In response to a reception of this detection signal, the control unit 31 opens the electromagnetic solenoid valve 137a associated with the air tube 117a which is connected to the air cylinder 49a of the metal press die 17a. As a result, the air is supplied to the air cylinder 49a through the connected path 113a and the air supply connector 131a, so that the movable die 47a moves toward the fixed die 45a, and the workpiece W is held between the fixed and movable dies 45a and 47a.

At this point, the press machine 15a is actuated, and the one end of the workpiece W is cut for a predetermined length as shown in FIG. 17(A) as a manufacturing step (a1) to complete the first manufacturing step for that one end. After the first manufacturing step for the one end is completed, the electromagnetic solenoid valve associated with the air exhaust tube which is connected with the air cylinder 49a is opened by the control unit 31 to exhaust the air in the air cylinder 49a, so that the movable die 47a and the fixed die 45a are separated to release the workpiece W.

Figure 17B:
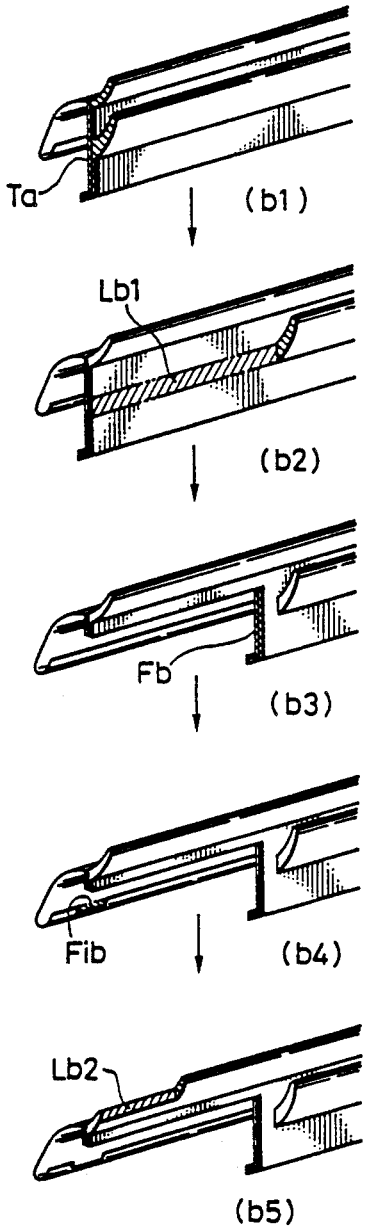

Then, the multi-joint robot 1 pulls out the workpiece W from the metal press die 17a and swings around to insert the other end of the workpiece W into the metal press die 17b of the second press apparatus 5. After the other end of the workpiece W is inserted, the other end of the workpiece W is cut for a predetermined length as shown in FIG. 17(B) as a manufacturing step (b1) to complete the first manufacturing step for the other end, which is similar to the cutting by the metal press die 17a of the first press apparatus 3 described above. By these first manufacturing steps, the workpiece W of a desired length is obtained.

Then, the multi-joint robot 1 swings around again to the first press apparatus 3 while holding the workpiece W so as to have a second manufacturing step done on the one end of the workpiece W.

Here, during the period of time in which the multi-joint robot 1 pulls out the workpiece W from the metal press die 17a of the first press apparatus 3, the prescribed press manufacturing is completed at the second press apparatus 5, and the workpiece W is transferred by the multi-joint robot 1 to the first press apparatus 3 again, the control unit 31 opens the electromagnetic solenoid valve associated with the air tube connected to the supply nozzle 101a of the cylinder 95a so that the air is supplied to the cylinder 95a and the rotary table 11a of the first press apparatus 3 is lifted up by the lifting mechanisms 91a, and then rotates the rotary table 11a in a direction indicated by an arrow A in FIG. 2 in a state in which the rotary table 11a is supported only by the roller 102a.

The rotational motion of the rotary table 11a is then controlled to decelerate by the break 35a, and the rotary table 11a is stopped at 60° rotated position as the stoppers come into the draining holes on the rotary table 11a shortly after that controlling by the break 35a. In addition, at this point, the positioning pins are inserted into the holes on the rotary table 11a from the base frame 9a in order to position the rotary table 11a. As a result, the metal press die 19a is placed below the vertically movable ram 27a of the first press apparatus 3 so as to prepare for the second manufacturing step for the one end of the workpiece W.

Likewise, during a period of time in which the second manufacturing step for the one end of the workpiece W is completed by the first press apparatus 3, and this workpiece W is transferred back to the second press apparatus 5, the rotary table 11b of the second press apparatus 5 is rotated by 60° in the direction indicated by an arrow A in FIG. 2, so as to prepare for the second manufacturing step of the other end of the workpiece W by the metal press die 19b on the rotary table 11b of the second press apparatus 5.

The operations similar to those described above will be performed for the subsequent manufacturing steps, such that the both ends of the workpiece W are manufactured alternatively by the first and the second press apparatuses 3 and 5.

The entire end treatment manufacturing process for the one end of the workpiece W is completed in five manufacturing steps using the metal press dies 17a–25a of the first press apparatus 3. The order of this manufacturing is shown in FIG. 17(A) as a sequence of manufacturing steps (a1)–(a5). The first manufacturing step (a1) is a cutting Ta of a predetermined length, the second manufacturing step (a2) is a first lip cutting La1 of the synthetic resin portion, the third manufacturing step (a3) is flange cutting Fa, the fourth manufacturing step (a4) is an inner flange cutting Fia, and the fifth manufacturing step is a second lip cutting La2 of the synthetic resin portion.

On the other hand, the entire end treatment manufacturing process for the other end of the workpiece W is completed also in five mnufacturing steps using the metal press dies 17b–25b of the second press apparatus 5. The order of this manufacturing is shown in FIG. 17(B) as a sequence of manufacturing steps (b1)–(b5), which are similar to the manufacturing steps (a1)–(a5) in FIG. 17(A) described above.

When the fifth manufacturing steps for both ends of the workpiece W are completed and thereby the entire manufacturing process for one workpiece W is completed, the multi-joint robot 1 swings backwards while holding the workpiece W in order to replace the workplace W on the carry-out conveyer 147 of the workpiece carrier apparatus 143.

Then, while the workpiece carrier apparatus 143 is activated to intermittently carry away the finished workpiece W on the carry-out conveyor 147, the next workpiece W to be manufactured is intermittently carried over on the carry-in conveyer 145 to prepare for the next gripping by the multi-joint robot 1. This operation of the workpiece carrier apparatus 143 is also to be controlled by the control unit 31, along with the controlling of the multi-joint robot 1 and the first and second press apparatus 3 and 5.

On the other hand, After completion of the fifth manufacturing steps (a5) and (b5) by the metal press dies **25*a* and 25*b*, both the first and second press apparatus 3 and 5 repeats the 60° rotation of the rotary tables 11*a* and 11*b* continuously twice to skip the blank B, and prepare for the first manufacturing steps (a1) and (b1) by the metal press dies 17*a* and 17*b*** for the next workpiece W to be manufactured.

The rotary table **11*a* is rotated by a predetermined angle as the rotation axis 65*a* of the driving motor 63*a* turns once around when one pulse of currents is supplied to the driving motor 63*a* by the command from the control unit 31. Namely, as the rotation axis 65*a* of the driving motor 63*a* turns once around the rotary plate 67*a* also turns once around, but during its course, as the pin 69*a* rotates a half around along the cam groove 73*a* of the horizontally movable plate 71*a* from the right middle side towards a top to the left middle side continuously, the horizontally movable plate 71*a* is moved to the left, and as the rack bar 77*a* is also moved to the left along with this move, the one way clutch 81*a* as well as the pinion 79*a* are rotated in the clockwise direction. In this situation, the one way clutch 81*a* is engaged with the driving axis 83*a* on the side having the gear 61*a* so that the gear 61*a* rotates and the rotary table 11*a* is rotated by the predetermined angle. This point is detected and the break 35*a* is actuated to stop the rotation of the rotary table 11*a*, but as the driving motor 63*a* further rotates a half around and the pin 69*a* subsequently rotates a half around along the cam groove 73*a* of the horizontally movable plate 71*a* from the left middle side towards a bottom to the right middle side continuously such that the horizontally movable plate 71*a* is moved to the right and the rack bar 77*a* is also moved to the right along with this move, the one way clutch 81*a* as well as the pinion 79*a* are rotated in counter-clockwise direction. In this situation, the one way clutch 81*a* is disengaged with the driving axis 83*a* on the side having the gear 61*a* so as to rotates freely in the opposite direction, such that the gear 61*a* does not rotates and the no driving force is transmitted to the rotary table 11*a***.

Figure 18:
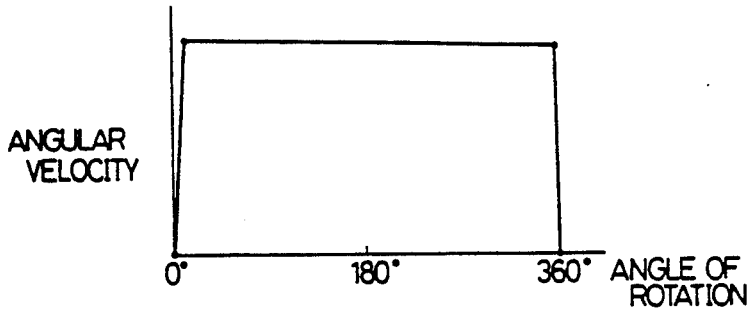
FIG. 18 is a diagram of an angular velocity versus an angle of rotation for explaining a rotationaol motion of a driving motor for the rotary table of FIG. 6.
Figure 19:
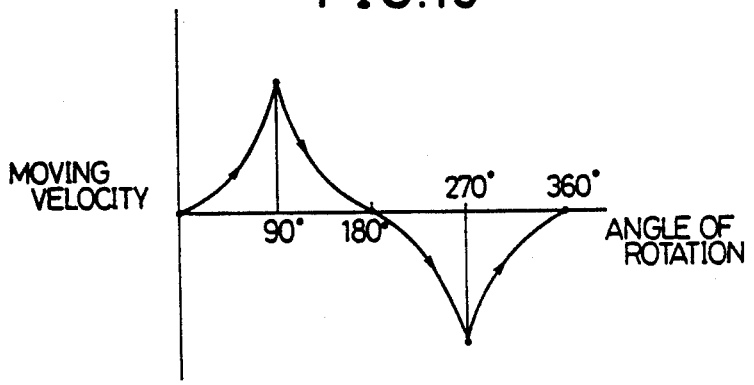
FIG. 19 is a diagram of a moving velocity versus an angle of rotation for explaining a motion of a portion driven by a driving motor for the rotary table of FIG. 6.
Figure 20:
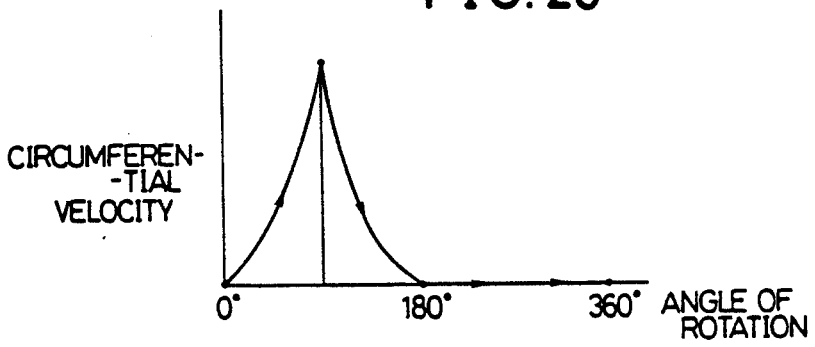
FIG. 20 is a diagram of a circumferential velocity versus an angle of rotation for explaining a rotation of the rotary table of FIG. 6.

Thus, the motions of each portion in this driving mechanism can be expressed in graphs shown in FIGS. 18 to 20. It can be seen in these graphs of FIGS. 18 to 20 that even when the rotation angle of the motor driving axis is one rotation rotated continuously as shown in FIG. 18, the moving velocity of the horizontally movable plate **71*a* and the rack bar 77*a* is in a state as shown in FIG. 19, and because the circumferential velocity of the rotary table 11*a* slows down near the beginning and end of the rotation as shown in FIG. 20, the torque needed at the starting of the motor rotation axis 65*a* is less so that the driving motor 63*a* is less loaded, and a weaker pressing pressure is sufficient for the stopping break 35*a* for the rotary table 11*a***.

As described, according to this embodiment, in the manufacturing of the ends of the long workpiece W by the manufacturing apparatus in plurality of manufacturing steps, while the manufacturing for the one end of the workpiece W is done by the first press apparatus 3, the rotary table **11*b* of the second press apparatus 5 for manufacturing the other end is rotated to prepare for the next manufacturing, and likewise while the manufacturing for the other end is done by the second press apparatus 5, the rotary table 11*a* of the first press apparatus 3** is rotated to prepare for the next manufacturing, so that even when many manufacturing steps are necessary as in this case in which ten steps altogether are required for manufacturing both ends of the workpiece W, the operation time loss can be small and the productivity can be high.

Also, despite the fact that many manufacturing steps are necessary, only two press apparatus are used, and since the press manufacturing position for one press apparatus is unique, the operational region of the robot can be made small which makes automatization easier.

It is to be noted that in the embodiment described above, the both ends of the workpiece W are to be manufactured in the identical manner, so that the first press apparatus 3 is devoted for manufacturing the one end of the workpiece W whereas the second press apparatus 5 is devoted for manufacturing the other end of the workpiece W. However, the present invention is applicable to cases in which the manufacturing steps for the one end may be more numerous than those for the other end, in which case the extra manufacturing steps for the one end may be done by using both of the first and second press apparatuses 3 and 5.

Furthermore, it is to be noted that although in the embodiment described above, the rotary table is utilized as means for carrying the plurality of metal press dies, this feature of the above embodiment may be replaced by different table arrangements such as that in which a table carrying the plurality of metal press dies moves linearly underneath the ram of the press machine, or any other suitable arrangements.

It is also to be noted that cases calling for more numerous manufacturing steps can be handled by using additional press apparatus such as the third and fourth press apparatuses. Conversely, in cases in which the manufacturing steps are not as numerous such as that requiring not more than six steps, only one press apparatus may be activated out of two or more press apparatuses provided.

Besides these, many modifications and variations of the above embodiments may be made without departing from the novel and advantageous features of the present invention. Accordingly, all such modifications and variations are intended to be included within the scope of the appended claims.

What is claimed is:

1. An apparatus for manufacturing a workpiece, comprising:

at least two manufacturing means for applying manufacturing steps to the workpiece, each one of which including:

a press machine having a ram;

a table means for carrying a plurality of manufacturing press dies corresponding to different manufacturing steps to be applied to the workpiece, the table means being capable of moving the manufacturing press dies intermittently under the ram of the press machine such that any one of the manufacturing press dies can be placed under the ram of the press machine selectively;

means for transferring the workpiece among the manufacturing means, capable of transferring the workpiece in and out of one manufacturing press die of one manufacturing means placed under the ram of the press machine;

means for controlling the manufacturing means and the transferring means such that while one manufacturing step is being applied by one manufacturing means and then the workpiece is being tranferred by the transferring means from that one manufacturing means to another manufacturing means for applying a next manufacturing step to the workpiece, the table means of the another manufacturing means is intermittently moved to prepare for the next manufacturing step by placing an appropriate one of the manufacturing press dies under the ram of the press machine of the another manufacturing means.

2. The apparatus of claim 1, wherein the table means comprises a rotary table rotatable around the press machine.

3. The apparatus of claim 2, wherein the plurality of manufacturing press dies are arranged on the table means along its circumference with a predetermined interval between neighboring manufacturing press dies.

4. The apparatus of claim 1, wherein the transferring means comprises a multi-joint robot.

5. The apparatus of claim 1, wherein the transferring means is located between two manufacturing means for manufacturing two ends of the workpiece.

6. A method of manufacturing a workpiece, comprising the steps of:

(a) providing at least two manufacturing means for applying manufacturing steps to the workpiece, each one of which including:

a press machine having a ram;

a table means for carrying a plurality of manufacturing press dies corresponding to different manufacturing steps to be applied to the workpiece, the table means being capable of moving the manufacturing press dies intermittently under the ram of the press machine such that any one of the manufacturing press dies can be placed under the ram of the press machine selectively;

(b) providing means for transferring the workpiece among the manufacturing means, capable of transferring the workpiece in and out of one manufacturing press die of one manufacturing means placed under the ram of the press machine;

(c) controlling the manufacturing means and the transferring means such that while one manufacturing step is being applied by one manufacturing means and then the workpiece is being transferred by the transferring means from that one manufacturing means to another manufacturing means for applying a next manufacturing step to the workpiece, the table means of the another manufacturing means is intermittently moved to prepare for the next manufacturing step by placing an appropriate one of the manufacturing press dies under the ram of the press machine of the another manufacturing means.

7. The method of claim 6, wherein the table means comprises a rotary table rotatable around the press machine.

8. The method of claim 7, wherein the plurality of manufacturing press dies are arranged on the table means along its circumference with a predetermined interval between neighboring manufacturing press dies.

9. The method of claim 6, wherein the transferring means comprises a multi-joint robot.

10. The method of claim 6, wherein the transferring means is located between two manufacturing means for manufacturing two ends of the workpiece.

* * * * *